United States Patent [19]

Huggins

[11] 4,292,923

[45] Oct. 6, 1981

[54] DEVELOPMENT SYSTEM

[75] Inventor: Raymond W. Huggins, Pittsford, N.Y.

[73] Assignee: Xerox Corporation, Stamford, Conn.

[21] Appl. No.: 57,868

[22] Filed: Jul. 16, 1979

[51] Int. Cl.[3] ..... G03G 13/09

[52] U.S. Cl. ..... 118/658; 355/3DD

[58] Field of Search ..... 118/657, 658, 656, 651; 355/3 DD

[56] References Cited

U.S. PATENT DOCUMENTS 3,620,191 11/1971 Lyles .

3,996,892 12/1976 Parker et al. ..... 118/658

*Primary Examiner*—John P. McIntosh

*Attorney, Agent, or Firm*—Harvey M. Brownrout; H. Fleischer

[57] ABSTRACT

An apparatus which transports particles into contact with a surface having image areas and background areas recorded thereon with the electrical potential of the image areas being greater than the electrical potential of the background areas. The apparatus has an electrical potential which varies substantially continuously from a level substantially equal to the electrical potential of the background areas to a level greater than the electrical potential of the background areas. In this manner, particles deposited on the surface adhere to the image areas with the background areas being substantially particle free.

16 Claims, 3 Drawing Figures

DEVELOPMENT SYSTEM

This invention relates generally to an apparatus for developing image areas with particles. An apparatus of this type is frequently employed in an electrophotographic printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing developer mix into contact therewith. This forms a powder image on the photoconductive member which is subsequently transferred to a copy sheet. Finally, the powder image is heated to permanently affix it to the copy sheet in image configuration.

Invariably, a residual charge or background remains on the photoconductive member in non-image areas which tends to hold developer particles thereon. This unwanted background, if not removed from the photoconductive member, is subsequently transferred to the copy sheet and results in a degradation of copy quality. Frequently, development systems employ two magnetic brush developer rollers. The first roller, as seen by the moving photoconductive member, is electrically biased to a level substantially equal to the voltage level of the background. This insures that all of the low density image areas are thoroughly developed, as well as possibly developing the background areas. The electrical potential applied to the second roller is above the magnitude of the background potential. In this way, the developer particles deposited in the background areas are scavenged from the photoconductive member, whereas the developer material adhering to the image areas remains thereon.

Various techniques have been devised for preventing the development of background areas recorded on the photoconductive member. The following disclosures appear to be relevant:

U.S. Pat. No. 3,620,191
Patentee: Lyles
Issued: Nov. 16, 1971
U.S. Pat. No. 3,996,892
Patentee: Parker et al.
Issued: Dec. 14, 1976

The pertinent portions of the foregoing disclosures may be briefly summarized as follows:

Lyles discloses a cascade development system having a series of electrodes separated from one another by insulating blocks and supported in close parallel relation to the rotating photoconductive drum so as to form a flow path therebetween, i.e. the development zone. The first electrode, in the direction of drum rotation, is electrically biased to a potential below the potential found in the non-imaged or exposed areas of the drum. This improves solid area development. The second electrode is electrically biased to a potential intermediate the background and image areas. This electrode enhances image development and scavenges random background developer from the drum surface. The third electrode is biased to a high potential of the same polarity as the drum. This electrode cleans loosely held developer from the drum surface.

Parker et al. describes a magnetic brush development system having an applicator roll comprising a stationary permanent magnet supported within a cylindrical, non-magnetic rotatable sleeve. The sleeve has a plurality of spaced, axially extending, elongated conductors disposed about its axis of rotation. A plurality of stationary contacts are slidably coupled to the conductors at spaced apart points around the axis of rotation of the sleeve. The contacts are connected to different voltage supplies. The bias voltage applied to the conductors vary as a function of the rotation of the sleeve. The sleeves comprise an electrically insulative core supporting the conductors and a resistive medium having a high coefficient of friction coating the surface thereof. A suitable resistive medium is conductive rubber doped with carbon black. Typically, the insulative core of the sleeve is a phenolic resin, paper based tube. Each conductor is basically an equipotential surface. A voltage drop determined by the bias voltages applied to adjacent conductive electrodes is impressed across the intervening portion of the resistive medium. The portion of each conductor free of the resistive coating permits the contacts to be coupled thereto. Each contact always engages at least one conductor. The conductor in the nip region is biased from about 250 to about 300 volts so as to inhibit background development. The conductors in the pre-nip region are biased to about 100 volts. The conductors in the post-nip region of the development zone may be biased to a voltage of approximately 1000 volts.

In accordance with the features of the present invention, there is provided an apparatus for developing image areas of a surface having image areas and background areas recorded thereon with the electrical potential of the image areas being greater than the electrical potential of the background areas. The apparatus includes means, positioned adjacent the surface to define a development zone, for advancing particles into contact with the surface. Means electrically bias the advancing means so that the electrical potential thereof, in the development zone, varies substantially continuously from a level substantially equal to the electrical potential of the background areas to a level greater than the electrical potential of the background areas. In this manner, particles deposited on the surface adhere to the image areas with the background areas being substantially particle free.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
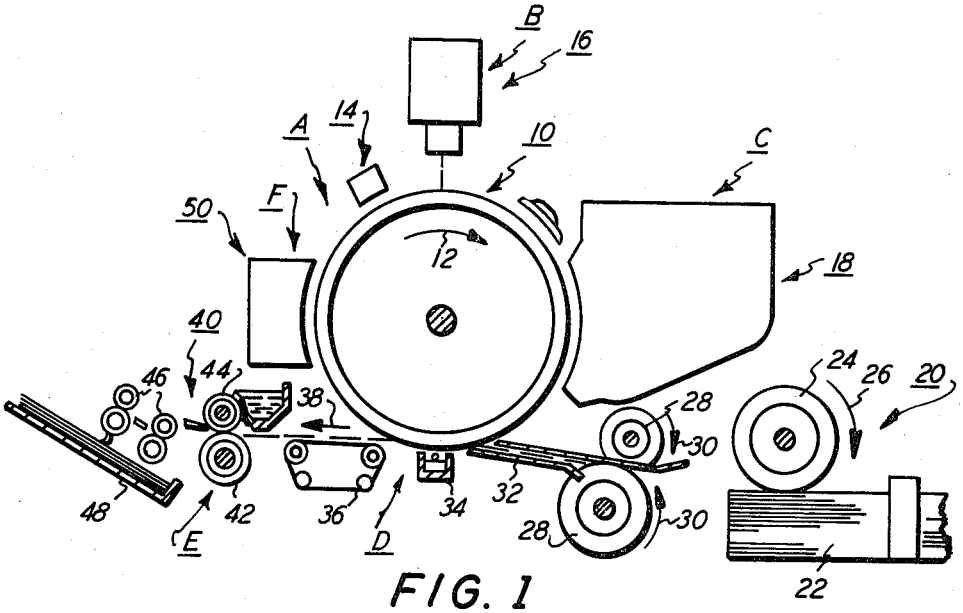
FIG. 1 is a schematic elevational view depicting an electrophotographic printing machine incorporating the elements of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussion that the development system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a drum, indicated generally by the reference numeral 10. Preferably, drum 10 includes a conductive substrate, such as aluminum, having a photoconductive material, e.g. a selenium alloy deposited thereon. Drum 10 rotates in the direction of arrow 12 to pass through the various processing stations disposed thereabout.

Initially, drum 10 moves a portion of the photoconductive surface through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through exposure station B. At exposure station B, an original document is positioned face-down upon a transparent platen. The exposure system, indicated generally by the reference numeral 16, includes a lamp which moves across the original document illuminating incremental widths thereof. The light rays reflected from the original document are transmitted through a moving lens to form incremental width light images. These light images are focused onto the charged portion of the photoconductive surface. In this manner, the charged photoconductive surface of drum 10 is discharged selectively by the light images of the original document. Those areas which remain substantially undischarged will hereinafter be referred to as the image areas. While those areas which are discharged will hereinafter be referred to as the background areas. The informational areas contained within the original document are recorded on the photoconductive surface of drum 10 as the image areas while the background areas contain the non-informational areas of the original document. It is clear that the exposure to light of the charged portion of the photoconductive surface fails to totally discharge the background areas. Thus, the background areas retain some residual voltage level. For example, the background areas may have a nominal potential of about 150 volts while the image areas have nominal potentials of about 800 volts.

Next, drum 10 advances the image areas and background areas recorded on the photoconductive surface to development station C. At development station C, a magnetic brush development system, indicated generally by the reference numeral 18, transports particles into contact with the photoconductive surface of drum 10. The particles contact both the image areas and background areas. The electrical potential of the magnetic brush development system is shaped so that initially both the image areas and background areas at least partially, are developed with these particles. This produces excellent solid area coverage in the image areas. Thereafter, as the development process proceeds, the developer material is removed from the background or non-image areas and remains adhering to the image areas. In this manner, the image areas retain a high density of particles while the non-image areas have the particles scavenged therefrom and are substantially particle free.

One skilled in the art will appreciate that either single component or two component developer materials may be employed. When single component materials are used, the developer material is preferably ferro-magnetic. When a two component development material is employed, the carrier granules are made preferably from a ferro-magnetic material with the toner particles being made preferably from a thermo plastic material. The toner particles adhere triboelectrically to the carrier granules. During development, the toner particles are attracted to the photoconductive surface so as to form a powder image corresponding to the informational areas of the original document. Furthermore, the toner particles may be charged either positively or negatively with the potential applied to the photoconductive surface being of a polarity opposite thereto.

The detailed structure of development system 18 will be described hereinafter with reference to FIGS. 2 and 3. Continuing now with the various processing stations disposed in the electrophotographic printing machine, after the powder image is deposited on the photoconductive surface, drum 10 advances the powder image to transfer station D.

At transfer station D, a sheet of support material is positioned in contact with the powder image formed on the photoconductive surface of drum 10. The sheet of support material is advanced to the transfer station by a sheet feeding apparatus, indicated generally by the reference numeral 20. Preferably, sheet feeding apparatus 20 includes a feed roll contacting the uppermost sheet of the stack 22 of sheets of support material. Feed roll 24 rotates in the direction of arrow 26 so as to advance the uppermost sheet from stack 22. Registration rollers 28, rotating in the direction of arrows 30, align and forward the advancing sheet of support material into chute 32. Chute 32 directs the advancing sheet of support material into contact with the photoconductive surface of drum 10 in a timed sequence. This insures that the powder image contacts the advancing sheet of support material at transfer station D.

Transfer station D includes a corona generating device 34, which applies a spray of ions to the backside of the sheet. This attracts the powder image from the photoconductive surface of drum 10 to the sheet. After transfer, the sheet continues to move with drum 10 and is separated therefrom by a detack corona generating device (not shown) which neutralizes the charge causing the sheet to adhere to the drum. Conveyor 36 advances the sheet, in the direction of arrow 38, from transfer station D to fusing station E.

Fusing station E, indicated generally by the reference numeral 40, includes a back-up roller 42 and a heated fuser roller 44. The sheet of support material with the powder image thereon passes between back-up roller 42 and fuser roller 44. The powder image contacts fuser roller 44 and the heat and pressure applied thereto permanently affix it to the sheet of support material. Although a heated pressure system has been described for permanently affixing the particles to a sheet of support material, a cold pressure system may be utilized in lieu thereof. The type of fusing system employed depends upon the type of particles being utilized in the development system. After fusing, forwarding rollers 46 advance the finished copy sheet to catch tray 48. Once the copy sheet is positioned in catch tray 48, it may be removed therefrom by the machine operator.

Invariably after the sheet of support material is separated from the photoconductive surface of drum 10, some residual particles remain adhereing thereto. These residual particles are cleaned from drum 10 at cleaning station F. Preferably, cleaning station F includes a cleaning mechanism 50 which comprises a pre-clean corona generating device and a rotatably mounted fiberous brush in contact with the photoconductive surface of drum 10. The pre-clean corona generating device neutralizes the charge attracting the particles to the photoconductive surface. The particles are then cleaned from the photoconductive surface by the rotation of the brush in contact therewith. Subsequent to cleaning, a discharge lamp floods the photoconductive surface with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
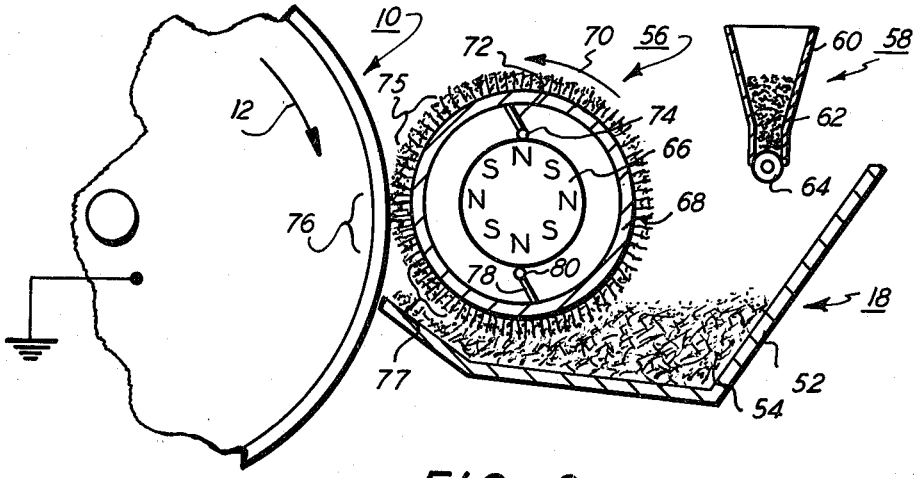
FIG. 2 is a schematic elevational view showing the development system employed in the FIG. 1 printing machine.

Referring now to the specific subject matter of the present invention, FIG. 2 depicts development apparatus 18 in greater detail. As shown thereat, development system 18 includes a housing 52 storing a supply of developer mixture 54 comprising carrier granules and toner particles. A developer roller, indicated generally by the reference numeral 56, is positioned in housing 52 and arranged to transport developer mixture 54 into contact with the photoconductive surface of drum 10. In operation, toner particles 62 are deposited on the photoconductive surface. Thus, it is clear that developer mixture 54 becomes depleted of toner particles 62. Accordingly, additional toner particles 62 are furnished to developer mixture 54 either periodically or continuously. A toner dispenser, indicated generally by the reference numeral 58, furnishes additional toner particles 62 to developer mixture 54. Toner dispenser 58 includes a hopper 60 having a supply of toner particles 62 therein. A roller 64, preferably made from a polyurethane material, is disposed in the lowermost aperture of hopper 60. As roller 64 rotates, it dispenses toner particles 62 from hopper 60 into developer mixture 54. This maintains the concentration of toner particles 62 within developer mixture 54 substantially constant.

Developer roller 56 includes an elongated cylindrical magnet 66 mounted interiorly of tubular member 68. Tubular member 68 rotates, in the direction of arrow 70, while magnet 66 remains substantially stationary. By way of example, magnet 66 is made from a barium ferrite material having magnetic poles impressed thereon. Tubular member 68 is made preferably from a phenolic tube having carbon particles dispersed therein. A plurality of spaced apart leaf springs 72 are integral with an electrical conductor 74 secured by suitable means, such as an adhesive, to magnet 66 prior to development zone 76, as indicated by arrow 12 showing the direction of rotation of drum 10. A second set of spaced apart leaf springs 78 are secured to electrical conductor 80. Electrical conductor 80 is also attached to magnet 66 by suitable means, such as an adhesive. Electrical conductor 80 is positioned after development zone 76, as indicated by arrow 12 showing the direction of the rotation of drum 10. Both sets of leaf springs 72 and 78 are electrically conductive and resilient. Preferably, electrical conductor 74 is coupled to a voltage source which generates a voltage level of about 50 volts. Electrical conductor 80 is connected to a second voltage source which generates a voltage level of about 350 volts. Preferably, the resistivity of tubular member 68 between conductor 74 and conductor 80 ranges from about $10^5$ ohms to about $10^7$ ohms. Inasmuch as tubular member 68 is made from a resistive material, an electrical potential field is formed therein which varies continuously from about 50 volts to about 350 volts. In the region just prior to development zone 76, i.e., pre-nip development zone 75, the electrical potential applied to tubular member 68 is about 150 volts while in the region just after or post development zone 76, i.e., the post nip development zone 77, the electrical potential is about 250 volts. It is clear that the electrical potential applied to tubular member 68 in pre-nip development zone 75 is about 150 volts which corresponds to the background voltage of about 150 volts while the electrical potential applied thereto in post nip development zone 77 is about 250 volts which is greater than the background voltage.

In pre-nip development zone 75, the potential applied to tubular member 68 is substantially equal to the background potential. Thus, the force fields associated with the solid image areas and the background areas are relatively strong. This results in an extremely heavy concentration of toner particles being provided at the photoconductive surface during the start of development. In this manner, early development of the solid areas is greatly enhanced. However, this also produces substantial development of the background areas. As the tubular member continues to rotate in the direction of arrow 70, the electrical potential applied thereto continually increases. In post-nip development zone 77, the electrical potential applied on tubular member 68 is greater than the electrical potential of the background areas. This potential acts to clean up the background. This electrical potential functions primarly to establish a high directional field capable of attracting the toner particles in the background areas back to the carrier granules on tubular member 68. Thus, this latter zone acts to attract the weakly held background particles to tubular member 68. Hence, the developer roller acts, in this zone, to scrub and electrostatically attract weakly held background particles from the drum surface. In this manner, the background areas remain substantially particle free while the toner particles continue to adhere to the image areas.

In the main development zone, indicated by the reference numeral 76, the electrical potential applied to tubular member 68 varies continuously from the potential of pre-nip development zone 75 or the background potential to a level less than that of post-nip development zone 77, which is less than the image potential. Thus, only the image areas attract the toner particles thereto so as to further enhance image development. By way of example, the potential in pre-nip development zone 75 is about 150 volts with the potential in post-nip development zone 77 being about 250 volts. Hence, the voltage in main development zone 76 varies from about 150 volts to about 250 volts.

Figure 3:
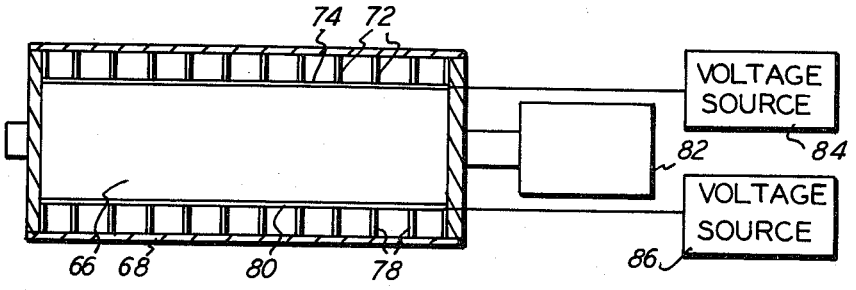
FIG. 3 is a schematic plan view illustrating the developer roller employed in the FIG. 2 development system.

Referring now to FIG. 3, there is shown the detailed structure of developer roller 66. As depicted thereat, motor 82 rotates tubular member 68 in the direction of arrow 70 (FIG. 2) at a substantially constant speed. Tubular member 68 is mounted rotatably on suitable bearings. Motor 82 rotates tubular member 68 with magnetic member 66 remaining substantially fixed or stationary. Conductor 74 is secured to magnet 66 with a plurality of substantially equally spaced leaf springs 72 extending outwardly therefrom in sliding contact with the interior circumferential surface of tubular member 68. Voltage source 84 is connected to conductor 74. Preferably, voltage source 84 generates about 50 volts. Conductor 80 is secured to magnet 66 and has a plurality of equally spaced leaf springs 78 extending outwardly therefrom. Leaf springs 78 slidingly contact the interior circumferential surface of tubular member 68. Voltage source 86 is connected to conductor 80 and preferably generates about 350 volts. By way of example, the electrical conductors and leaf springs may be formed as a integral assembly by a conventional photoresist type of etching or metal stamping technique. It is clear that the potential extending in a direction substantially parallel to the longitudinal axis of the tubular member 68 is substantially constant. This is due to the fact that each leaf spring applies the same voltage to tubular member 68 with the leaf springs extending in a direction substantially parallel to the longitudinal axis thereof. Each leaf spring is in sliding engagement with tubular member 68. Of course, there is some voltage gradient between adjacent leaf springs. However, inasmuch as the leaf springs are positioned fairly close to one another, this ripple effect is minimal. Hence, each increment of tubular member 68 parallel to the longitudinal axis thereof is at a substantially equipotential. However, the voltage level varies substantially continuously about the circumferential surface of tubular member 68 from about 50 volts, applied by voltage source 84, to about 350 volts, applied by voltage source 86.

In recapitulation, it is clear that the improved development system of the present invention generates a continuously varying potential in the development zone which enhances solid area development while maintaining the background areas substantially particle free. This is achieved by electrically biasing the tubular member to a voltage level substantially equal to the background voltage in the pre-nip development zone with the post-nip development potential being greater than the background potential. Thus, the potential applied to the development roller in the main development zone continuously increases from the background voltage to a potential greater than the background voltage. The pre-nip potential, i.e. the potential substantially equal to the background voltage, promotes development of the solid areas. The post-nip potential, i.e. that voltage which is greater than the background voltage, provides a cleaning action which removes any particles deposited on the background areas so that only the image areas have particles adhering thereto. In the main development zone, the potential varies continuously from the background potential to a level less than the potential of the post-nip development zone. Thus, only the image areas attract toner particles in this zone. It is thus clear that the development system of the present invention provides excellent solid area development while maintaining the background areas substantially particle free.

It is, therefore, evident that there has been provided, in accordance with the present invention, an apparatus for developing the image areas recorded on a photoconductive surface while maintaining the background area substantially particle free. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing image areas of a surface having image areas and background areas recorded thereon with the electrical potential of the image areas being greater than the electrical potential of the background areas, including:

a tubular member made from a resistive material having conductive particles dispersed substantially uniformly therethrough, said tubular member being positioned adjacent the surface to define a development zone for transporting particles into contact with the surface;

a magnetic member disposed interiorly of said tubular member;

a pair of voltage sources for supplying different fixed voltages; and a pair of second conductors, having no other conductors interposed therebetween one of said conductors being positioned prior to the development zone with the other of said conductors being positioned after the development zone, each of said pair of conductors having one end region thereof slidably engaging said tubular member with the other end region thereof being connected to one of said pair of voltage sources to electrically bias said tubular member so that the electrical potential thereof, in the development zone, varies substantially continuously from a level substantially equal to the electrical potential of the background areas to a level greater than the electrical potential of the background areas so that particles deposited on the surface adhere to the image areas with the background areas being substantially particle free.

2. An apparatus as recited in claim 1, wherein each of said conductors includes a plurality of substantially equally spaced leaf springs with one end of each of said leaf springs being connected to one of said pair of voltage sources and the other end thereof being in sliding engagement with said tubular member, said leaf springs extending in a direction substantially parallel to the longitudinal axis of said tubular member with each of said leaf springs being substantially normal to the longitudinal axis of said tubular member so as to apply a substantially uniform potential on said tubular member in a direction substantially parallel to the longitudinal axis of said tubular member.

3. An apparatus as recited in claim 2, wherein one of said pair of voltage sources generates a voltage level less than the voltage level of the background areas and the other of said pair of voltage sources generates a voltage level greater than the voltage level of the background areas.

4. An apparatus as recited in claim 3, wherein said transporting means includes means for rotating said tubular member with said magnetic member being substantially stationary.

5. An apparatus as recited in claim 4, wherein said one of said pair of voltage sources generating the voltage level less than the voltage level of the background area is connected to said one of said pair of conductors engaging said tubular member before the development zone and said other of said pair of voltage sources generating the voltage level greater than the voltage level of the background areas is connected to said other of said pair of contacts engaging said tubular member after the development zone.

6. An apparatus as recited in claim 5, wherein said tubular member has a resistivity ranging from about $10^5$ ohms to about $10^{17}$ ohms in the region intermediate said pair of spaced conductors.

7. An apparatus as recited in claim 6, wherein said tubular member includes a sleeve made from a phenolic material having carbon particles dispersed therein.

8. An apparatus as recited in claim 7, wherein said other end of said leaf springs engage the interior circumferential surface of said tubular member.

9. An electrophotographic printing machine of the type having a photoconductive member having image areas and background areas recorded thereon with the electrical potential of the image areas being greater than the electrical potential of the background areas, wherein the improvement includes:

a tubular member made from a resistive material having conductive particles dispersed substantially uniformly therethrough, said tubular member being positioned adjacent to the photoconductive member to define a development zone for transporting a developer mixture comprising carrier granules and toner particles into contact with the photoconductive member;

a magnetic member disposed interiorly of said tubular member;

a pair of voltage sources for supplying different fixed voltages; and a pair of spaced conductors, having no other conductors interposed therebetween one of said conductors being positioned prior to the development zone with the other of said conductors being positioned after the development zone, each of said pair of conductors having one end region thereof slidably engaging said tubular member with the other region thereof being connected to one said pair of voltage sources to electrically bias said tubular member so that the electrical potential thereof, in the development zone, varies substantially continuously from a level substantially equal to the electrical potential of the background areas to a level greater than the electrical potential of the background areas so that toner particles deposited on the photoconductive member adhere to the image areas with the background areas being substantially free of toner particles and carrier granules.

10. A printing machine as recited in claim 1, wherein each of said conductors include a plurality of substantially equally spaced leaf springs with one end of each of each of said leaf springs being connected to one of said pair of voltage sources and the other end thereof being in sliding engagement with said tubular member, said leaf springs extending in a direction substantially parallel to the longitudinal axis of said tubular member with each of said leaf springs being substantially normal to the longitudinal axis of said tubular member so as to apply a substantially uniform potential on said tubular member in a direction substantially parallel to the longitudinal axis of said tubular member.

11. A printing machine as recited in claim 10, wherein one of said pair of voltage sources generates a voltage level less than the voltage level of the background areas and the other of said pair of voltage sources generates a voltage level greater than the voltage level of the background areas.

12. A printing machine as recited in claim 11, wherein said transporting means includes means for rotating said tubular member with said magnetic member being substantially stationary.

13. A printing machine as recited in claim 12, wherein said one of said pair of voltage sources generating the voltage level less than the voltage level of the background areas is connected to said one of said pair of conductors engaging said tubular member before the development zone and said other of said pair of voltage sources generating the voltage level greater than the voltage level of the background areas is connected to said other of said pair of conductors engaging said tubular member after the development zone.

14. A printing machine as recited in claim 13, wherein said tubular member has a resistivity ranging from about $10^5$ ohms to about $10^7$ ohms in the region intermediate said pair of spaced conductors.

15. A printing machine as recited in claim 14, wherein said tubular member includes a sleeve made from a phenolic material having carbon particles dispersed therein.

16. A printing machine as recited in claim 15, wherein said other end of said leaf spring engages the interior circumferential surface of said tubular member.

* * * * *